United States Patent [19]

Ernster et al.

[11] Patent Number: 4,462,694

[45] Date of Patent: Jul. 31, 1984

[54] AGITATOR ASSEMBLY FOR USE IN BLENDER APPLIANCE

[75] Inventors: Peter J. Ernster, Glendale; Henry Jacyno, Franklin, both of Wis.

[73] Assignee: Sunbeam Corporation, Oak Brook, Ill.

[21] Appl. No.: 525,641

[22] Filed: Aug. 23, 1983

[51] Int. Cl.[3] ..... B01F 7/16

[52] U.S. Cl. ..... 366/205; 366/314; 403/26; 403/300; 241/282.2

[58] Field of Search ..... 366/343, 205, 199, 314, 366/197, 206; 241/282.2, 282.1; 403/26, 300, 301, 359

[56] References Cited

U.S. PATENT DOCUMENTS

| | | | |
|---|---|---|---|
| 3,175,594 | 3/1965 | Jepson | 366/199 |
| 3,343,816 | 9/1967 | Reed | 366/314 |
| 3,368,800 | 2/1968 | Barnard | 241/282.2 |
| 3,612,126 | 10/1971 | Emmons | 366/205 |
| 3,786,999 | 1/1974 | Cabell | 366/205 |
| 3,881,705 | 5/1975 | Greenspan | 366/205 |

*Primary Examiner*—Robert W. Jenkins

*Attorney, Agent, or Firm*—Neil M. Rose; Clifford A. Dean; Robert J. Fox

[57] ABSTRACT

An agitator assembly for a blender appliance including a diaphragm closure for the bottom opening in a blender vessel with a pair of spaced bearings supported on said diaphragm and a two-piece shaft assembly to interconnect the motor drive and the comminuting blades, the two-pieces being coupled by a spline connection which eliminates the need for accurate bearing alignment.

10 Claims, 4 Drawing Figures

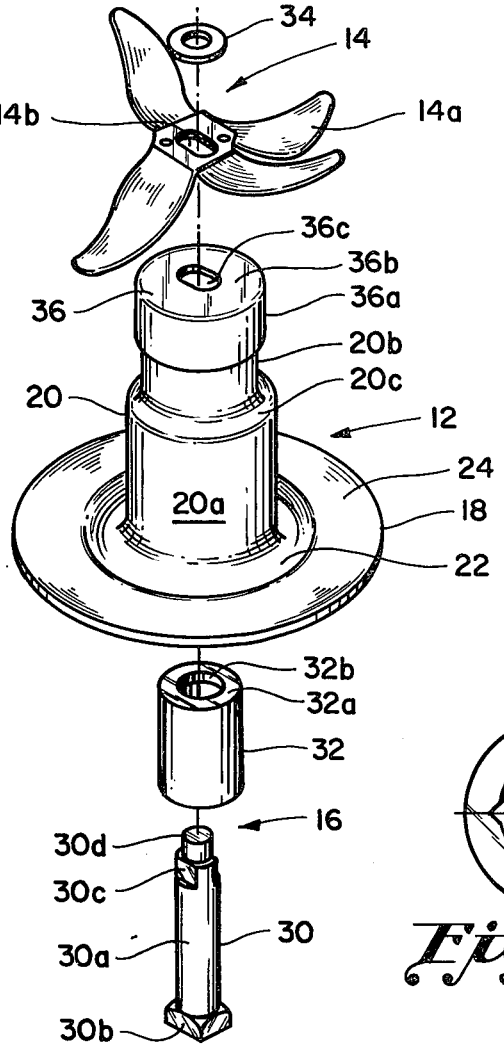
Fig. 1
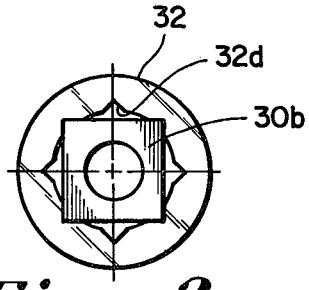
Fig. 2
Fig. 3
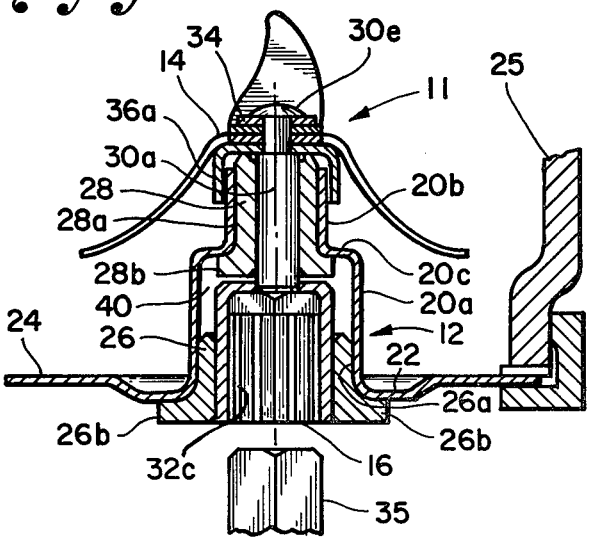
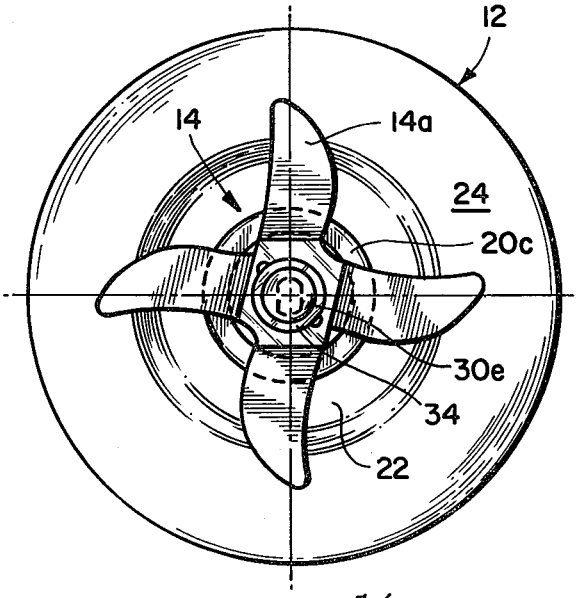
Fig. 4

AGITATOR ASSEMBLY FOR USE IN BLENDER APPLIANCE

BACKGROUND OF THE INVENTION

The invention relates to an agitator assembly for use in an electric blender of the type in which the blender vessel is provided with a large bottom opening through which the drive connection between the motor driven power unit and the blades in the blender vessel must be made. The blender has been a popular and well-accepted domestic appliance for more than twenty-five (25) years. It is characterized by being powered by a powerful motor which drives blades which chop and mix the contents of the blender vessel. Although most blenders are adapted to operate at a range of different speeds, the maximum speed is usually on the order of 18,000 to 20,000 revolutions per minute under no load and 5,000 to 11,000 revolutions per minute under load.

This requirement that the blades rotate at such high speeds necessitates the use of a strong well-aligned drive connection between the motor and the blade assembly. Because of the substantial amount of power and speed involved, any significant misalignments in the driving connection can cause serious vibration and wear. The problem is further complicated by the fact that the bearings for the blade supporting shaft must maintain their leakproof condition since even though the blender vessel is sometimes filled with dry foods, it is more often than not utilized in connection with liquids.

Although some of the prior art blenders utilize cup-shaped blender vessels in which the blades and their supporting shaft are permanently mounted in the bottom of the vessel, the more popular approach from the consumer's standpoint is one in which the agitator assembly and the bottom wall of the vessel which supports the assembly are removable for cleaning purposes. The latter type of approach presents some sealing problems in that the separable bottom wall must normally seal against the periphery of an opening in a glass vessel. To facilitate sealing against the molded walls of the glass vessel, it is known to use a flexible diaphragm member which in combination with the sealing gasket is clamped against the bottom wall of the vessel. The flexibility of the diagram can accommodate variations in the dimensions of the glass vessel.

In the prior art blenders utilizing such diaphragm bottoms, it has been known to form a flange on the diaphragm within which a pair of spaced axially aligned bearings would be mounted. A drive shaft would then be utilized which would mount the blade assembly at the upper end within the vessel and have a splined opening in the lower end thereof to receive the output shaft of the motor drive unit. This arrangement provided the detachable drive connection between the motor and the blades permitting the blender vessel to be separated from the power unit so it may be washed more readily.

The one-piece shaft and the spaced bearings which supported it, tended to be high in manufacturing cost and difficult to manufacture properly. The one-piece shaft was of reduced diameter at its upper end where it was journaled in the upper bearing and was of substantially greater diameter at its lower end where it had a machined cavity to receive the output drive shaft. This shape resulted in a part that was very expensive to manufacture, requiring a considerable amount of machining. In addition, because of the fact that two spaced bearings were mounted in a drawn flange in the diaphragm, it was difficult to achieve accurate alignment of the bearings so that the one-piece shaft would be properly journaled therein.

Another problem which increased the cost of the prior art agitator assembly was the requirement that the parts be corrosion resistant. This required the use of stainless steel material. Typically, a piece of ½ inch stainless steel bar stock would be used to turn down and machine the upper portion of the shaft, while drilling, undercutting and broaching the lower end of the shaft was required for the splined drive connection. All of these operations were particularly expensive considering the necessity that stainless steel be used. It would be desirable, therefore, to provide an agitator assembly which would be easier and less expensive to manufacture than the prior art devices.

BRIEF DESCRIPTION OF THE INVENTION

In order to overcome the problems associated with the prior art agitator assembly, applicants have provided a two-piece shaft assembly which substantially reduces the manufacturing cost of the agitator assembly and which reduces the rejection rate in manufacturing and overcomes the need for very accurate alignment of the shaft supporting bearings. The upper shaft portion is a simple turned part having a square lower end which is received in and keyed to the same splined opening which receives the end of the motor drive shaft to drivingly couple the blades to the motor. The lower portion of the shaft assembly is a socket member which is separately journaled in the lower bearing while the upper shaft unit is journaled in the upper bearing. By having two parts which are coupled by the spline connection, a limited amount of misalignment of the bearings is accommodated without any binding between the shaft and the bearings.

The socket portion of the shaft is received on the lower end of the upper shaft portion while the blade assembly is secured on the upper end of the upper shaft portion. Thus, the shaft assembly is retained in assembled relation to the agitator assembly by the socket portion and the blade assembly which both straddle the upper bearing and prevent disassembly of the shaft therefrom.

It is therefore an object of the present invention to provide a simplified and improved agitator assembly for a blender appliance.

It is a further object of the present invention to provide a two-piece shaft assembly for drivingly interconnecting the power unit to the blade assembly in an agitator assembly.

Another object of the present invention is to provide a two-piece shaft assembly in an agitator assembly for a blender wherein the upper portion of the shaft assembly is mounted in one bearing and the lower portion is mounted in a second bearing with the interconnecting portions of the shaft assembly accommodating a certain amount of bearing misalignment.

Further objects and advantages will become apparent as the following description proceeds and the features of novelty which characterize the invention will be pointed out in the claims annexed to and forming a part of the specification.

BRIEF DESCRIPTION OF THE DRAWINGS

FIG. 1 is an exploded perspective view of an agitator assembly for a blender appliance embodying our invention;

FIG. 2 is a bottom plan view of the shaft assembly of the agitator assembly of FIG. 1 shown in the assembled relation;

FIG. 3 is a vertical sectional view through the central axis of the agitator assembly of FIG. 1 showing the parts in their normal assembled relation; and FIG. 4 is a top plan view of the agitator assembly of FIG. 3 assuming FIG. 3 showed a complete assembly.

DESCRIPTION OF THE PREFERRED EMBODIMENT

Referring now to the drawings, there is shown an agitator assembly designated generally by reference numeral 11. The agitator assembly includes a diaphragm assembly 12, a blade assembly 14, and a shaft assembly 16. The diaphragm assembly 12 is made up of a generally circular diaphragm member 18 which is formed with a central flange 20 having a large diameter portion 20*a*, an upper reduced diameter portion 20*b* and an interconnecting shoulder portion 20*c*. At the bottom of the upstanding flange 20, there is a depressed annular ring 22 which connects with the outer annular rim 24. The material of which the diaphragm 18 is formed is lightweight stainless steel which is corrosion resistant but is sufficiently thin to be flexible so that the rim 24 may flex slightly to accommodate to the dimensional variations of a blender vessel 25 (a part of which is shown in FIG. 3) within which it might be mounted.

The diaphragm assembly 12 further includes a pair of bearings 26 and 28, the lowermost bearing 26 being larger in diameter than the bearing 28. As is best shown in FIG. 3, the bearing 26 is received within the lower flange portion 20*a* having a cylindrical portion 26*a* and a flanged portion 26*b* which abuts the lower surface of the annular portion 22 of the diaphragm 18. The bearing 26 is press fitted into the lower flange portion 20*a* of the diaphragm 18.

The upper bearing 28 is formed with a cylindrical portion 28*a* which is received within the upper flange portion 20*b* and includes a flange portion 28*b* which abuts against the stepped portion 20*c* of the flange 20. Like the bearing 26, the upper bearing 28 is press fitted into the upstanding flange 20.

The shaft assembly 16 includes shaft or blade shaft 30 and socket 32 which are adapted to be supported in the bearings 26 and 28 in substantial axial alignment. The shaft 30 is machined from either cylindrical or square stainless steel bar stock being turned to have a central uniform diameter portion 30*a* which extends from the enlarged end portion 30*b* having a square cross-section. At the upper end, shaft 30 is formed with a noncircular flatted portion 30*c* and a cylindrical portion 30*d*. The noncircular flatted portion 30*c* is adapted to receive the blade assembly 14 which comprises four stainless steel cutting, chopping and mixing blades 14*a*. The central portion of the blade assembly 14 is formed with a noncircular opening 14*b* which is adapted to be snugly received on the end 30*c* of the shaft 30 to establish a driving connection between the shaft 30 and the blade assembly 14 whereby there would be no relative rotation between the two parts. After the shaft assembly 16 has been assembled to the diaphragm assembly 12 and the blade assembly 14 positioned on the shaft portion 30*c*, the portion 30*d* of the shaft 30 is swaged to the shape indicated by 30*e* in FIG. 3. The cylindrical end portion 30*d* is spun or peened over to form an enlarged retaining head 30*e* which engages a retaining washer 34.

The socket 32, which forms the lowermost portion of the shaft assembly 16 is shown in FIG. 1 as having a uniform outer diameter and an end wall 32*a* through which an opening 32*b* extends. Extending upwardly from the lower end of the socket 32 is an enlarged opening 32*c* which extends all the way from the lower end of the socket 32 up to the upper wall 32*a* providing a passageway 32*c* which extends axially through the socket 32 from one end to the other. The walls of the passageway 32*c* are formed with splined grooves 32*d* there being a total of eight grooves, providing two sets of four of which are adapted to engage the corners of the square end portion 30*b* as is best shown in FIG. 2. It should be noted that the square end portion 30*b* is of the same cross-section dimension as drive portion 35 of the output shaft of the power unit to which the shaft assembly 12 is detachably connectable. In FIG. 3, the drive portion 35 is shown separated from its drive connection with the socket 32.

When the shaft 30 and the socket 32 are fully assembled, the shaft portion 30*a* extends through the opening 32*b* in the socket 32 and the squared end portion 30*b* of the shaft 30 is seated against the end wall 32*a* as is best shown in FIG. 3. As assembled in that position, the corners of the squared portion 30*b* are in driving engagement with the splined portions 32*d* as best shown in FIG. 2.

Once the shaft assembly 16 has been assembled by inserting the socket 32 over the shaft 30 and then the shaft assembly 16 has been assembled to the diaphragm assembly 12 and the blade assembly 14 secured to the upper end of the shaft assembly 16, the agitator assembly 11 is complete. It should be noted that to minimize leakage along the shaft 30, a ferrule 36 is secured to the upper end of the shaft 30 immediately below the blade assembly 14. The ferrule 36 has a generally cup-shaped configuration with cylindrical side walls 36*a*, a top wall 36*b* and a noncircular opening 36*c* which is received on the flatted portion 30*c* of the shaft 30 adjacent the blade assembly 14. As is evident from FIG. 3, the cylindrical walls 36*a* overlap with the upper flange portions 20*b* and tend to prevent liquid from entering the bearings spaced between the shaft assembly 16 and its bearings 26 and 28.

It should also be noted that the upstanding flange 20 and the bearings 26 and 28 are formed to provide an annular space 40 between the two bearings. This space is filled with grease which tends to lubricate the adjacent bearing portions.

The socket 32 is formed of sintered stainless steel which provides a simple and inexpensive means of fabricating the complex contours of the splined wall of the passageway 32*c*. It is further noted that there is a clearance of several thousandths of an inch between the shaft 30 and the interior dimensions of the socket 32 so that even though a good driving connection is achieved between the socket 32 and the blade assembly 14, the parts of the shaft assembly may tolerate a certain amount of misalignment in the bearings 26 and 28 without binding resulting as the shaft is rotated. Any upward or downward thrust on the blade assembly 14 or the socket 32 is absorbed by the end surface of the bearing 28 which is adapted to take such axial thrust. The splined socket 32 performs the dual function of detachably connecting the power unit output shaft to the agitator assembly and also to connect the two parts of the blade assembly providing compensation or allowance for bearing misalignment.

The above-described agitator assembly provides an improved design which is easier and less expensive to manufacture and which results in a higher quality product since problems with bearing misalignment have been virtually eliminated.

What is claimed as new and desired to be secured by Letters Patent of the United States is:

1. An agitator assembly for use in a blender vessel having a detachable closure for a bottom opening comprising a diaphragm assembly being flexible to conform to a bottom opening in a blender jar, said diaphragm assembly having a central flange within which two axially aligned and spaced bearings are mounted, a two-piece shaft assembly supported for rotation by said bearings, said shaft assembly including a cylindrical socket and a shaft, said socket having a passageway extending axially therethrough, said passageway having an enlarged diameter portion extending from one end to a plane adjacent the other end where it connects with a reduced diameter portion which extends through to the other end, said socket being journaled in one of said bearings, said shaft being elongated with a central portion journaled in the other of said bearings, an enlarged noncircular portion at one end of said shaft being sized to slide axially into said enlarged diameter portion of said passageway and engage the walls thereof to lock said socket and said shaft against relative rotation, a blade assembly, said shaft having an end remote from said enlarged portion to which said blade assembly is secured adjacent the upper end of said other bearing, said socket and said blade assembly retaining said shaft assembly in assembled relation to said diaphragm assembly.

2. The agitator assembly of claim 1 wherein said enlarged diameter portion of said passageway being formed with splines therein and said enlarged noncircular portion of said shaft having a square cross-section which is slidably received in said passageway with the corners of said square engaging said splines to lock said socket and shaft against relative rotational movement.

3. The combination of claim 2 wherein said socket is formed of sintered stainless steel and said shaft is formed of stainless steel.

4. The agitator assembly of claim 1 wherein said socket is mounted on said closure with said passageway opening downwardly and adapted to receive for driving connection with said blade assembly the output drive shaft of a blender power unit.

5. The combination of claim 1 wherein said bearings are spaced apart forming an annular space inside of said central flange on said diaphragm, said annular space being filled with grease.

6. The combination of claim 1 wherein said remote end of said shaft is formed with a noncircular reduced diameter portion, said blade assembly having a noncircular central opening which receives said remote end of said shaft to prevent relative rotation between said blade assembly and said shaft, said remote end of said shaft being formed over said blade assembly to restrain said blade assembly from axial movement with respect to said shaft.

7. The combination of claim 6 wherein said blade assembly includes a pair of blades and an inverted cup-shaped ferrule which is secured to said remote end of said shaft and has side walls that extend downwardly in overlapping relation with the upper portion of said flange.

8. An agitator assembly for use in a blender vessel having a detachable closure for a bottom opening comprising a diaphragm assembly includes a generally circular flexible diaphragm having a central opening defined by an elongated stepped flange, said flange having a lower first and an upper second portion, said first portion being of greater diameter than said second portion, a pair of shouldered bearings mounted coaxially in said flange with a first bearing being partially received in said first portion and a second smaller diameter bearing being received in said second portion, a two-piece shaft assembly supported for rotation by said bearings, said shaft assembly including a cylindrical socket and a blade shaft, said socket having a passageway extending axially therethrough, said passageway having an enlarged diameter portion extending from one end to a plane adjacent the other end where it connects with a reduced diameter portion which extends through to the other end, said socket being journaled in said first bearing, said shaft being elongated with a central portion journaled in said second bearing, an enlarged portion of noncircular cross-section at one end of said shaft being sized to slide axially into said enlarged diameter portion of said passageway and engage the walls thereof to lock said socket and said shaft against relative rotation, a blade assembly, said blade shaft having an end remote from said enlarged portion to which said blade assembly is secured adjacent the upper end of said second bearing, said socket and said blade assembly retaining said shaft assembly in assembled relation to said diaphragm assembly.

9. A blender comprising a blender vessel having a blade shaft journaled in the bottom thereof and supporting a blade assembly for rotation within said vessel, said blender including a power unit having an output shaft adapted to drive said blade assembly through a detachable connection, said blade shaft having a drive portion at its lower end having an noncircular cross-section and said output shaft having a drive portion at its upper end which has a noncircular cross-section of substantially the same dimensions as said shaft drive portion, a socket journaled in said vessel bottom and having a passageway formed therein which receives said output shaft drive portion and said blade shaft drive portion to drivingly interconnect said shafts.

10. A blender comprising a blender vessel having a bottom opening provided with a detachable closure including a diaphragm assembly being flexible to conform to a bottom opening in a blender jar, said diaphragm assembly having a central flange within which two axially aligned and spaced bearings are mounted, a two-piece shaft assembly supported for rotation by said bearings, said shaft assembly including a cylindrical socket and shaft, said socket having a passageway extending axially therethrough, said passageway having an elongated diameter portion extending from one end to a plane adjacent the other end where it connects with a reduced diameter portion which extends through to the other end, said socket being journaled in one of said bearings, said shaft being elongated with a central portion journaled in the other of said bearings, an enlarged noncircular portion at one end of said shaft being sized to slide axially into said enlarged diameter portion of said passageway and engage the walls thereof to lock said socket and said shaft against relative rotation, a blade assembly, said shaft having an end remote from said enlarged portion to which said blade assembly is secured adjacent the upper end of said other bearing, said socket and said blade assembly retaining said shaft assembly in assembled relation to said diaphragm assembly, a power unit drive shaft having a drive portion with the same cross-section as said noncircular portion of said shaft and being adapted for detachable connection with said socket.

* * * * *